US006294076B1

(12) United States Patent
Genetti et al.

(10) Patent No.: US 6,294,076 B1
(45) **Date of Patent: *Sep. 25, 2001**

(54) FISCHER-TROPSCH WAX AND HYDROCARBON MIXTURES FOR TRANSPORT (LAW938)

(75) Inventors: W. B. Genetti; L. L. Ansell; Daniel F. Ryan, all of Baton Rouge, LA (US); Paul J. Berlowitz, Glen Gardner, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/556,736

(22) Filed: Apr. 21, 2000

(51) Int. Cl.[7] ..... C10G 73/00; C10G 73/32; C07C 27/00; C07C 7/20; C10L 1/16

(52) U.S. Cl. ..... 208/24; 208/37; 518/728; 585/9; 585/899

(58) Field of Search ..... 518/728; 208/24; 585/9, 899

(56) References Cited

U.S. PATENT DOCUMENTS

| | | | | |
|---|---|---|---|---|
| Re. 30,281 | * | 5/1980 | Tackett et al. | 208/93 |
| 5,866,751 | | 2/1999 | Womack, Jr. et al. | 585/899 |

* cited by examiner

*Primary Examiner*—Jean F. Vollano
*Assistant Examiner*—J. Parsa
(74) *Attorney, Agent, or Firm*—Jay Simon; Jonathan N. Provoost; Charles J. Brumlik

(57) ABSTRACT

The invention is a process for producing a mixture of Fischer-Tropsch product that is solid at ambient conditions (between 32° F. and 95° F.), such as wax, and hydrocarbon liquid, such as naphtha, that can be pumped at ambient temperature (between 32° F. and 95° F.). The temperature of the mixture is controlled below the melting point of the Fischer-Tropsch product. The present invention provides for the transport of Fischer-Tropsch product from a remote location in a readily available medium, such as naphtha, via pipeline, tanker or railcar. At the completion of the transport, the hydrocarbon liquid and Fischer-Tropsch product are separated by conventional methods such as flashing, distillation, or filtration with minimal contamination from the hydrocarbon liquid.

14 Claims, 1 Drawing Sheet

FISCHER-TROPSCH WAX AND HYDROCARBON MIXTURES FOR TRANSPORT (LAW938)

FIELD OF THE INVENTION

The present invention pertains to a process for producing a mixture of a Fischer-Tropsch product that is solid at ambient conditions (between 32° F. and 95° F.), such as Fischer-Tropsch wax, and a hydrocarbon liquid at ambient temperature, such as naphtha, that can be pumped from a remote location and subsequently separated by conventional methods such as flashing, distillation, or filtration with minimal contamination from the hydrocarbon liquid.

BACKGROUND INFORMATION

Oil fields typically have deposits of natural gas associated with them. In remote locations where transport of this gas may not be economically attractive, gas conversion technology can be used for chemically converting natural gas to higher molecular weight hydrocarbons. Current gas conversion technologies rely on the chemical conversion of natural gas to synthesis gas, which is a mixture of carbon monoxide and hydrogen. Synthesis gas is then reacted in a catalyzed hydrocarbon synthesis process commonly known as Fischer-Tropsch synthesis as described in U.S. Pat. No. 5,348,982 to form higher molecular weight hydrocarbons.

Waxes produced from the Fischer-Tropsch synthesis have many desirable properties. These waxes have very high purity since they are essentially free of any sulfur, nitrogen and aromatics. Additionally, Fischer-Tropsch waxes have high normal paraffin content.

Generally, the transport of wax is not a problem because the wax, which is typically a solid below 100° F., is produced at refineries or chemical plants with easy access to railcar or truck loading docks. However, most gas conversion plants are built in remote locations and hence, the above-mentioned conventional methods for shipping the wax are often unavailable.

Some methods for transporting the wax from a remote location include shipping it in a cargo bay as a solid, in heated tanks and tankers, in a solvent, steam traced pipelines, or as a slurry. Solutions and slurries are attractive methods because they can be pumped at ambient conditions. However, the availability of solvents in remote locations can be a problem.

Therefore, it is desirable to transport the Fischer-Tropsch product that is solid at ambient conditions in a medium that is readily available at a remote location and that is easily separated from the Fischer-Tropsch product upon completion of the transport with minimal contamination from the hydrocarbon liquid medium.

SUMMARY OF THE INVENTION

In accordance with the present invention, a Fischer-Tropsch product that is solid at ambient conditions (between 32° F. and 95° F.), such as a Fischer-Tropsch wax, is blended with hydrocarbon liquid at ambient temperature (between 32° F. and 95° F.), such as naphtha, to form a mixture that can be pumped at ambient temperature. The temperature of the mixture is controlled below the melting point of the Fischer-Tropsch product, thus producing a heterogeneous mixture.

The Fischer-Tropsch product and hydrocarbon liquid mixture is transported via conventional methods for the movement of liquids such as via pipeline, tanker, or railcar.

At the completion of the transport, the hydrocarbon liquid and Fischer-Tropsch product are separated by conventional methods such as flashing, distillation or filtration. The hydrocarbon liquid derived from the Fischer-Tropsch synthesis, which is available at a remote location, allows for the transport of the Fischer-Tropsch product with minimal contamination from the hydrocarbon liquid.

DETAILED DESCRIPTION OF THE INVENTION

The present invention provides a process for producing a mixture of Fischer-Tropsch product that is solid at ambient temperature, such as a Fischer-Tropsch wax, and a hydrocarbon liquid at ambient temperature, such as naphtha. For illustrative purposes, the Fischer-Tropsch product is a Fischer-Tropsch wax and the hydrocarbon liquid is naphtha. However, those skilled in the art recognize that any Fischer-Tropsch product that is solid at ambient temperature and any hydrocarbon liquid at ambient temperature could be used.

The mixture of Fischer-Tropsch wax and naphtha contains from about 1 to 22 weight percent Fischer-Tropsch wax, preferably about 8 to 10 weight percent, that can be pumped at ambient temperature.

Figure 1:
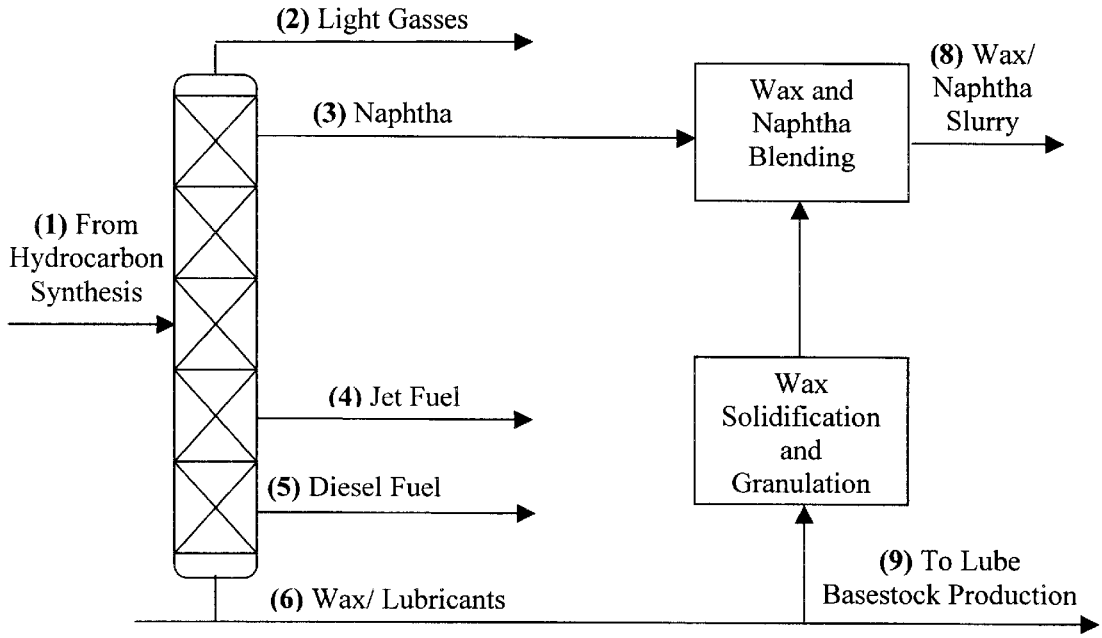
FIG. 1 is a process flow scheme for producing and transporting the Fischer-Tropsch product and hydrocarbon liquid mixture.
Figure 1:
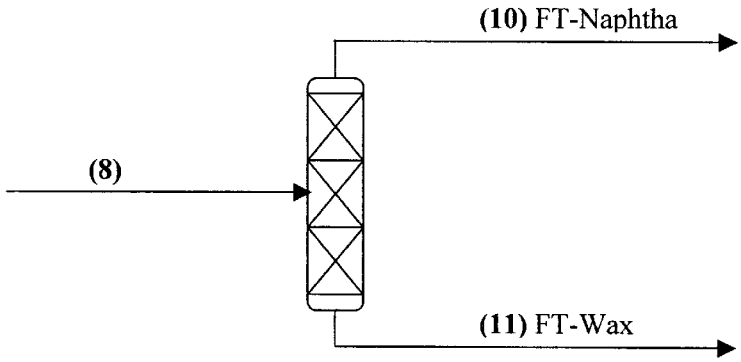

As illustrated in FIG. 1, the Fischer-Tropsch product (1) from a Fischer-Tropsch reactor is fractionated into products such as light gases (2), naphtha (3), jet fuel (4), diesel fuel (5), and a heavy hydrocarbon stream (6). The Fischer-Tropsch product (1) may be hydrotreated, processed, or hydroisomerized before separation, or may be separated and the fractionated products processed individually. The products may vary with operational objectives and could be used as produced or with additional hydrotreating, upgrading, blending, or additives.

The heavy hydrocarbon stream (6) could be the total wax from the Fischer-Tropsch synthesis, fractionated into specific boiling ranges, hydroisomerized to produce a lubricant basestock with solvent dewaxing to obtain the wax or any combination of these options. The wax from the heavy hydrocarbon stream (6) can be hydrotreated for sale of the wax as refined wax.

The wax, refined or unrefined, is solidified, granulated, and blended with all or part of the naphtha (3) to produce a heterogeneous Fischer-Tropsch wax and naphtha mixture (8). As previously mentioned, the amount of Fischer-Tropsch wax that can be blended is about 1 to 22 weight percent Fischer-Tropsch wax, preferably about 8 to 10 weight percent. The pour point of the mixture should be below about 75° F., more preferably below about 32° F. These ranges and pour points are based on the tendency for naphtha to swell the wax to form a paste at amounts above these ranges.

The viscosity of the mixture should be below about 1500 cP, preferably below about 500 cP. Otherwise, the increased viscosity will make the transport of the mixture more difficult.

The temperature of the mixture is controlled below the melting point of the wax to limit the solubility of the wax. Additionally, the molecular weight difference between the wax and the naphtha also helps to limit the solubility of the wax. This objective is important because it is the soluble wax that becomes deposited on the walls of a pipeline or tanker. The deposited wax typically leads to an increase in the pressure drop in the pipeline due to a reduction in the cross-sectional area and hence, a reduced efficiency in the transport of the mixture.

Although any Fischer-Tropsch derived wax may be used in this invention, the preferred boiling range of the wax to be blended is about 700+° F., more preferably about 725° F. to 1025° F.

EXAMPLE

A Fischer-Tropsch synthesis product was fractionated to obtain naphtha with a boiling range from about 95° F. to about 320° F. The quality of separation was measured by High Temperature Simulated Distillation Gas Chromatography (GCD) using a HP 6890 series gas chromatograph. The wax was the total solid product from the Fischer-Tropsch synthesis at ambient conditions with a boiling range of 453° F. to 1129° F. based on 5 and 95 weight percent GCD, respectively. The GCD data are presented in Table 1 below.

TABLE 1

Naphtha and Wax GCD

| Boiling Range (° F.) | Naphtha (wt. %) | Wax (wt. %) |
|---|---|---|
| i/200 | 10.7 | No detected |
| 200/320 | 51.6 | 0.7 |
| 320/500 | 28.7 | 7.5 |
| 500/700 | 8.4 | 32.0 |
| 700/1000 | 0.6 | 45.9 |
| 1000+ | Not detected | 13.9 |

The mixtures were produced by granulating the wax into finely divided flakes and then mixing the wax with the naphtha in a colloid mill with varying rotor-stator gap widths and times. This blending process was repeated for a range of wax concentrations from about 7 to 30 weight percent.

Pour points were measured by an ISL pour point analyzer and the Brookfield viscosity was measured using a viscometer from about 100° F. to the pour point. The results are shown below in Table 2.

TABLE 2

Naphtha Wax Colloids Properties

| Total Wax (wt. %) | Pout Point (° F.) |
|---|---|
| 7 | 1 |
| 10 | 41 |
| 13 | 41 |
| 19 | 50 |
| 22 | 63 |
| 25 | 86 |
| 28 | Paste |
| 30 | Paste |

At total wax concentrations greater than about 28 weight percent, the mixture tended to form a paste due to the swelling of the wax caused by the naphtha. Total wax concentrations between about 7 and 22 weight percent wax yielded pour points below typical ambient conditions.

The ability to pump the mixture, as measured by the Brookfield viscosity at 32° F., was obtained for the 7 and 13 weight percent wax. The resulting values were 372 cP and 1218 cP, respectively. As indicated by the data, an increase in the wax concentration caused a substantial increase in the low temperature viscosity.

As previously mentioned, the dissolved wax deposits on the walls of the pipeline or tanker thereby decreasing the effectiveness of the transport operation. Plating on the walls occurs by deposition of dissolved wax on a cool surface and is proportional to the heat transfer at the interface. By limiting the amount of dissolved wax, surface coating can be reduced because the dissolved wax content is proportional to deposition. For the total wax having a boiling range of about 453° F. to 1129° F. only 5.5±2.0 grams of wax per liter of mixture were dissolved. Increasing the wax concentration did not increase the dissolved wax thus indicating that the mixture was saturated. These experiments were done at room temperature. For heavier waxes such as those having a boiling range of about 725° F. to 1025° F. instead of the entire 453° F. to 1129° F. fraction, the solubility of the wax in naphtha decreased and the separation became easier.

Visual observations of the mixture after two weeks indicated that agglomerates did not form in the mixture. However, due to the density difference between the naphtha and wax, some settling of solid particles in the mixture occurred. These wax particles were easily suspended by mild agitation thus indicating that settling of the mixture in a tank or tanker could be addressed by circulation or agitation either during shipment or before unloading of the mixture.

Separation of the wax and naphtha mixture was achieved by fractionating the mixture at 400° F. for the 7, 13, and 19 weight percent wax with goodness of cut determined by GCD as shown in Table 3 below. Fractionation will be sharper for higher boiling range Fischer-Tropsch waxes.

TABLE 3

Distillation Products After Blending

| | 7 wt. % | | 13 wt. % | | 19 wt. % | |
|---|---|---|---|---|---|---|
| Boiling Range (° F.) | Naphtha (wt. %) | Wax (wt. %) | Naphtha (wt. %) | Wax (wt. %) | Naphtha (wt. %) | Wax (wt. %) |
| i/200 | Not detected | Not detected | Not detected | Not detected | Not detected | Not detected |
| 200/320 | 23.5 | Not detected | 37.3 | Not detected | 25.5 | Not detected |
| 320/500 | 73.8 | 1.0 | 55.7 | 19.0 | 70.5 | 3.5 |
| 500/700 | 2.7 | 66.4 | 2.0 | 49.0 | 1.2 | 59.6 |

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the process may be varied substantially without departing from the spirit of the invention and the exclusive use of all modifications, which come within the scope of the appended claims, is reserved.

What is claimed is:

1. A process of forming a mixture of Fischer-Tropsch product and hydrocarbon liquid that can be pumped at ambient temperature comprising:

(a) combining said Fischer-Tropsch product that is solid at ambient temperature and said hydrocarbon liquid at ambient temperature to form a mixture that can be pumped at ambient temperature, and (b) controlling the temperature of said mixture below the melting point of said Fischer-Tropsch product.

2. A process according to claim 1, wherein said Fischer-Tropsch product is a Fischer-Tropsch wax.

3. A process according to claim 1, wherein said hydrocarbon liquid is naphtha having a boiling range of about 95° F. to 320° F.

4. A process according to claim 3 wherein said naphtha is produced by Fischer-Tropsch synthesis.

5. A process according to claim 2, wherein said mixture contains about 1 to 22 weight percent wax.

6. A process according to claim 1, wherein the pour point of the mixture is less than about 75° F.

7. A process according to claim 1, wherein the viscosity of the mixture is less than about 1500 cP.

8. A process according to claim 2, wherein the boiling range of said wax is about 700° F. to 1025° F.

9. A process according to claim 1, further comprising separating said Fischer-Tropsch product and said hydrocarbon liquid.

10. A process according to claim 9, wherein said separating is by flashing.

11. A process according to claim 9, wherein said separating is by distillation.

12. A process according to claim 9, where said separating is by filtration.

13. A process according to claim 1, where said ambient temperature is about 32° F. to 95° F.

14. A process according to claim 1, further comprising transporting said Fischer-Tropsch product and said hydrocarbon liquid.

* * * * *